US006058982A

United States Patent [19]

Fritzson

[11] Patent Number: 6,058,982

[45] Date of Patent: May 9, 2000

[54] YARN FEEDING DEVICE HAVING A BRAKE OPENING DEVICE FOR THREADING

[75] Inventor: Joachim Fritzson, Ulricehamn, Sweden

[73] Assignee: Iro AB, Ulricehamn, Sweden

[21] Appl. No.: 09/065,075

[22] PCT Filed: Nov. 7, 1996

[86] PCT No.: PCT/EP96/04889

§ 371 Date: Aug. 3, 1998

§ 102(e) Date: Aug. 3, 1998

[87] PCT Pub. No.: WO97/17277

PCT Pub. Date: May 15, 1997

[30] Foreign Application Priority Data

Nov. 10, 1995 [DE] Germany ..... 195 42 045

[51] Int. Cl.[7] ..... B65H 51/22; D03D 47/34

[52] U.S. Cl. ..... 139/452; 242/365.4

[58] Field of Search ..... 242/365.4; 139/452

[56] References Cited

U.S. PATENT DOCUMENTS

| | | | |
|---|---|---|---|
| 5,123,455 | 6/1992 | Maina | 139/452 |
| 5,343,899 | 9/1994 | Jacobsson et al. | 139/452 |
| 5,351,724 | 10/1994 | Zenoni et al. | 139/452 |
| 5,441,087 | 8/1995 | Alberyd et al. . | |
| 5,546,994 | 8/1996 | Sarfati . | |
| 5,778,943 | 7/1998 | Tholander | 139/452 |

FOREIGN PATENT DOCUMENTS

| | | |
|---|---|---|
| 0 436 900 A1 | 7/1991 | European Pat. Off. . |
| 0 567 045 A1 | 10/1993 | European Pat. Off. . |
| WO 91/14032 | 9/1991 | WIPO . |
| WO 92/22693 | 12/1992 | WIPO . |

*Primary Examiner*—Andy Falik

*Attorney, Agent, or Firm*—Flynn, Thiel, Boutell & Tanis, P.C.

[57] ABSTRACT

A yarn feeder includes a storage drum, and an unwinding brake which has a storage drum counter-braking surface continuous in the peripheral direction and coaxial to the axis of the storage drum. The unwinding brake further has a braking component supported on the counter-braking surface axially counter to the direction of yarn unwinding so as to produce spring action and having a coaxial braking surface also continuous in the peripheral direction. The yarn feeder also has a mounting for the braking component, and a pneumatic brake opening device which has a pressure chamber with a pneumatically loadable, axially movable boundary wall. The boundary wall is connected to the braking component so as to transmit movement at least in the direction of movement thereof counter to the action of the spring. When the boundary wall is pressurised by excess pressure or a vacuum, the braking component can be moved axially into a threading position in which the braking surface is lifted from the counter-braking surface.

14 Claims, 2 Drawing Sheets

YARN FEEDING DEVICE HAVING A BRAKE OPENING DEVICE FOR THREADING

FIELD OF THE INVENTION

The present invention relates to a yam feeding device having a brake element on an end of a storage drum wherein the brake element is openable for threading.

BACKGROUND OF THE INVENTION

In a yam feeding device which is known from WO 91/14032, a brake disc which defines the counter-brake surface of an output brake on the storage drum is tilted by means of a tilting element relative to the brake element, which abuts thereon with the brake surface, so as to open a wedge-shaped gap for threading a yam. The tilting element which is stored in the storage drum is operated by a piston rod of a piston which is displaceable in the pressure chamber of a mounting. The pressure chamber is connectable to a source of pressure by which a threading nozzle arranged in the output brake is also supplied. Apart from the great constructional efforts required for the brake opening device, it is difficult under adverse conditions to thread the yam properly into and through the output brake.

In a yam feeding device which is known from EP 0 567 045 A1, a piston rod which is extensible by means of a piston is provided outside of and next to the surface of the storage drum, with the piston rod directly acting on a brake surface-defining brake band of the brake element or on the brake element, and lifting the brake band in a locally defined area from the counter-brake surface on the storage drum to open a crescent-shaped threading gap for the yam. Apart from the constructional efforts and the problem of accommodating such an apparatus in view of the normally very limited space, the mechanical load on the brake element and the brake surface is great.

U.S. Pat. No. 5 778 943 (Tholander) discloses a remotely controlled output brake of a yarn feeder, namely an output brake, the brake element of which can be switched between on/off breaking conditions. In the on condition, the brake element is pressed axially against a counter-surface of the feeder storage body with a contact force set by the axial position of the sleigh positioning the entire brake arrangement at the front end region of the storage body. In the off position, said brake element contacts the counter-surface with almost no axial contact pressure or even is slightly detached therefrom. The actuation mechanism, e.g. a pneumatic drive, is integrated into the carrier structure of the brake arrangement. Said actuating mechanism engages in an outer holding ring of the brake element or via a push collar at a deformable portion of said brake element.

However, said actuation mechanism is not intended to provide a threading position of the brake element with sufficient axial distance between the brake element and the counter-surface to thread in a new yarn. Threading requires that the entire brake arrangement be displaced via its sleigh along the adjustment screw. Said procedure is time-consuming and cumbersome and nullifies the set contact pressure adjustment.

It is the object of the present invention to provide a yarn feeding device of the above-mentioned type and a method of opening an output brake which enable a yam of any desired yam quality to be threaded into and through the output brake rapidly and without any problems and at any time.

According to the invention, a brake opening device is provided for opening the brake with a sufficient stroke to allow the threading of a new yarn. Said brake opening device has an axially movable boundary wall which is pneumatically loadable in order to move with the pneumatic pressure in an axial direction. Said boundary wall is connected in motion transmitting fashion to said brake element in order to move said brake element with its brake surface into an axial position where said brake surface is sufficiently lifted from said counter brake surface to allow a new yarn to be passed therebetween.

In the embodiment wherein the boundary wall is pressurized by an elevated pressure or a vacuum to move the brake element to a threading position, the threading-in position can rapidly be established under small constructional efforts with the brake surface being entirely lifted from the counter-brake surface. The yam passes in unhindered fashion into the output brake, and it is above all easy to thread the yam through the output brake because it is nowhere clamped between the brake surface arid the counter-brake surface during the clock hand-like rotational movement along the free end of the storage drum. The brake opening device manages with a small number of components, it is space-saving and does not impair the normal brake function of the output brake.

Where a threading nozzle creates a suction flow acting on the pressure chamber adjacent the boundary wall the threading nozzle which is provided for automatically threading the yam feeding device is also used for adjusting the brake element into the threading position. When the boundary wall is moved under excess pressure, the pressure chamber can be connected to the same compressed-air supply as the threading nozzle. By contrast, when the boundary wall is acted upon with vacuum, the suction pressure of the suction flow of the threading nozzle is expediently used. Both measures have the benefit that upon start of a threading operation in the yam feeding device the brake element is automatically brought into the threading position and is already in the threading position when the free yam end arrives at the output brake.

However, it is also possible to connect the pressure chamber to a separate source of excess pressure or vacuum and to bring the brake element at a suitable time, for instance in advance of the activation of the threading nozzle, into the threading position.

The embodiment wherein the boundary wall is an elastic circular ring membrane is constructionally simple and reliable in function. An elastomer or rubber is suited as the material for the circular ring membrane. The circular ring membrane has the important advantage that it closes the interior of the mounting of the brake element to the outside, so that no impurities or lint pass into the output brake. The circular ring membrane can, for instance, be fixed by using an adhesive on the inner edge region and the outer edge region. However, it is also possible to fix the circular ring membrane by screwing or clamping. A planar circular ring membrane is here expediently used. However, it is also possible to use a membrane formed with concentric undulations to impair the intrinsic mobility of the brake element during the braking function as little as possible.

Alternatively, the embodiment is expedient, in which a circular ring piston is used for adjusting the brake element into the threading position. It is here possible to arrange the circular ring piston separated from the brake element and only to couple it with the brake element for moving said element into the threading position, for example, by the measures that the circular ring piston which is held by a restoring spring in an initial position acts on a carrier of the brake element upon actuation following an initial empty stroke and carries said element along. During normal braking function, the intrinsic mobility of the brake element which is important for the operation of the output brake is not at all impaired.

The embodiment wherein the circular ring piston is provided on the brake element or a tubular attachment connected thereto is advantageous because a simple adjustment of the brake element into the threading position is made possible with a few components.

Alternatively, the embodiment wherein the boundary wall is an end of a circular, hollow spring bellows is of importance, in which the spring bellows fulfills a double function because for threading purposes it is responsible for the adjustment of the brake element into the threading position, whereas otherwise it produces a resilient clamping of the brake surface against the counter-brake surface. The spring bellows may be made of metal or plastics.

Another important embodiment is provided wherein the brake element is a frustoconical jacket having a large opening which fits over a free end of the storage drum. This is an output brake of a very modem type in which the brake element cooperates by means of a wear-resistant brake band with the withdrawal edge region of the storage drum, i.e. on a relatively large diameter. Despite the relatively high spring force by which the jacket is axially pressed against the storage drum end, the brake element of this brake type can be rapidly and reliably adjusted with the boundary wall into the threading position in which the brake surface is lifted expediently completely from the counter-brake surface, so that the yam can be threaded through very easily. Mechanical load or deformation on the brake band is not at all observed here.

An alternative embodiment is an axial disc brake in which the yam enters from the outside and is deflected in the center of the brake element in withdrawal direction. The output brake operates on a relatively small diameter in comparison with the outer diameter of the storage drum, which permits a very sensitive braking operation and a brake element with a rapid response because of its light-weight construction. The brake element is rapidly moved by the boundary wall into the threading position in which the brake surface is lifted expediently completely from the counter-brake surface. The circular ring membrane protects the interior of the output brake against dirt and lint.

In the embodiment wherein the opposing brake surfaces are arranged in a direction perpendicular to an axial direction of the storage drum the brake surface and the counter-brake surface are substantially in a direction perpendicular to the axial drum direction. The yam which arrives in an inclined manner is first deflected radially to the interior and is then again deflected from the radial direction into the withdrawal direction. It is gently braked between the surfaces. The counter-brake surface can be arranged on a brake disc of its own, the brake disc being held on the storage drum, expediently movably. It is also possible to provide the counter-brake surface directly at the front ends of the storage drum. However, the brake surface and the counter-brake surface may also be conical to facilitate entry of the yam during threading.

In a further embodiment, the brake element is supported on a tubular attachment which is guided in a guide channel where such guide channel includes longitudinally extending ribs. This embodiment ensures a clean and easy guiding of the brake element and also a flow path with a large cross-section into and out of the pressure chamber.

Where the storage drum and brake element define, brake surfaces and the brake element is moved by suction pressure, the brake element can be lifted rapidly and expediently entirely from the brake surface to form a threading opening for the yam, the opening being open from all feed directions. The demand made on such output brakes because of the type of construction, according to which the brake element which is resiliently supported in the mounting under spring action towards the storage drum should be moved away from the storage drum in axial direction for threading the yam, can be met especially easily by the application of suction pressure.

According to claim 13 the suction pressure of the suction flow which is produced at any rate for threading the yam is used in an especially expedient manner for lifting the brake element from the brake surface, whereby a separate source of negative pressure can be dispensed with on the one hand and the opening movement of the output brake is synchronized, at least substantially, on the other hand by the simultaneously started threading process of the yam feeding device.

BRIEF DESCRIPTION OF THE DRAWINGS

Embodiments of the subject matter of the invention shall now be explained with reference to the drawings, in which.

DETAILED DESCRIPTION

Figure 1:
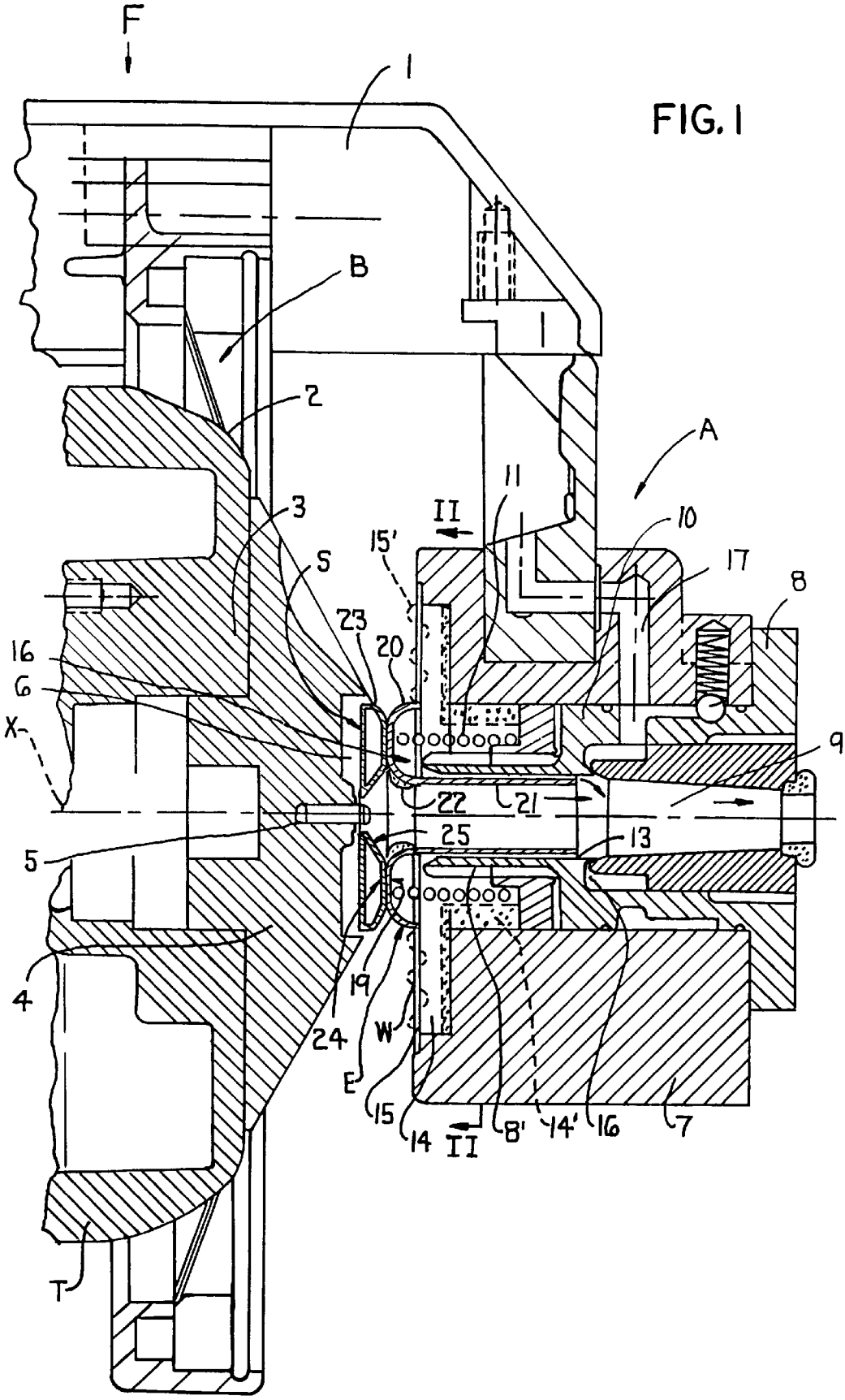
FIG. 1 is a longitudinal section through part of a yam feeding device having an output brake.

A yam feeding device F according to FIG. 1, for instance a yam storing and feeding device for projectile or gripper weaving machines, of which only the free end part 3 of a storage drum T is shown, as well as an extension arm 1 fixed onto the housing, has a free end of the storage drum T provided with an output brake A which is designed as a coaxial disc brake. The storage drum T has a withdrawal edge region 2 for the yam (not shown) and a yam brake B which cooperates in said region with the storage drum T and which is arranged in extension arm 1. The yam brake B can selectively be equipped with a bristle ring, a lamella basket or also with a brake band which is uninterrupted in the circumferential direction and which is resiliently pressed against the withdrawal edge region.

A frustoconical insert 5 which supports a coaxial brake disc S in a recess 6 by means of a bearing member 5 which is positioned in the storage drum axis X is mounted at the end member 3 of the storage drum T. The brake disc S is either tiltable on all sides or axially movable against a spring mounting (not shown). However, it is also possible to arrange the brake disc in a fixed manner or to form the counter-brake surface directly on the insert 4 or on the end member 3. The output brake A has a housing-like mounting 7 which is secured to the extension arm 1 and by which a rotationally symmetrical, axially movable brake element E which is coaxial to the storage drum axis X is pressed under axial spring action (spring 11) against the brake disc S. The outer diameters of the brake disc S and the brake element E are considerably smaller than the outer diameter of the storage drum, for instance, half the size at the most. The brake disc S defines a circular annular counter-brake surface on which an also circular annular brake surface of the brake element E rests in a planar manner.

A central adjusting screw 8 which, together with the brake element E, forms a yam guiding channel 9 through the withdrawal brake A is rotatably supported in the mounting 7. A spring abutment 10 which is supported in the mounting 7 against rotation and has to be adjusted axially by rotating the adjusting screw 8 for varying the clamping force between the brake surface and the counter-brake surface by changing the bias of spring 11 can be screwed onto a tubular extension 8' of the adjusting screw 8. The extension 8' of the adjusting screw 8 encompasses a tubular attachment 21 of the brake element E with a radial play 13 in such a manner that the brake element E is axially guided. The radial play 13 defines a flow connection 13 to a pressure chamber 14 which is defined by an axially movable boundary wall W. The boundary wall W is a circular ring membrane (of a planar or undulated (15') type) made from a flexible material such as rubber or elastomer which is fixed with its outer edge on the mounting 7, for instance by using an adhesive, and which is connected with its inner edge to the brake element E in motion-transmitting fashion, for instance by using an adhesive.

Figure 2:
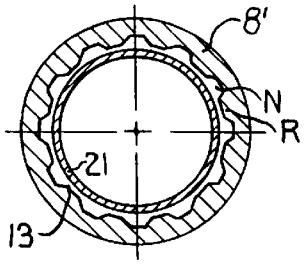
FIG. 2 is a cross-section taken in plane II—II of FIG. 1.

According to FIG. 2 the inner wall of the extension 8' may be formed with longitudinally extending ribs R and grooves N to provide a large flow cross-section towards the pressure chamber 14 and, nevertheless, to guide the tubular attachment in a neat manner.

The yam guiding channel 9 has disposed therein a threading nozzle 16 which is connected to a compressed-air supply 17 and upon whose activation with compressed air, a blow flow can be produced in the end section of the yam feeding channel 9, which is at the right side in FIG. 1, whereas a suction flow which propagates into the surroundings of the brake disc S and of the brake element E to the outside can be produced in the tubular attachment 21 of the brake element E. The suction pressure of the suction flow is transmitted by the flow connection 13 or N also into the pressure chamber 14 (arrow 18), whereby the boundary wall W (the circular ring membrane 15) in FIG. 1 is displaced in FIG. 1 to the right side and carries along the brake element E until the element passes into a threading position in which the brake surface is entirely lifted from the counter-brake surface and a gap which is accessible on all sides is formed for the yam to the sucked in. The threading position can be defined, for instance, by the brake element E abutting on the mounting 7 or by placing the tubular attachment 21 in the yam guiding channel 9.

In this embodiment, the brake element E is a light-weight metal part having the shape of a circular ring disc which has an outer edge 20 bent rearwards to the outside, a planar ring flange 19 which is perpendicular to the storage drum axis X, and the tubular attachment 21 which extends from the inner diameter of the ring flange 19 in the withdrawal direction. In the transition region from the ring flange 19 into the tubular attachment 21 a ceramic yam eyelet 22 may be inserted in the interior. The ring flange 19 defines the brake surface with its planar front side facing the storage drum T. The brake disc S has a similar configuration. It has an outer edge 23 bent rearwards, a planar ring flange 25 perpendicular to the storage drum axis X and a central recess 25. The circular ring flange 24 defines the counter-brake surface of the output brake A with its front side facing the mounting 7. The circular ring flanges 24, 19 are perpendicular to the axis X.

At least one further threading nozzle (not shown) is provided in the yam feeding device for threading a yam. Furthermore, the yam brake B can be moved with respect to the withdrawal edge region 2 into a gap position to pass the yam axially supplied with the aid of compressed air from the above-mentioned threading position and to guide the yam inwards before it is gripped by the suction flow of the threading nozzle 16 and is sucked between the brake surface lifted from the counter-brake surface and the brake surface therethrough into the yam guiding channel 9 and is blown out from said channel. After the threading operation has been completed, the threading nozzles are deactivated, the yam brake B is again moved into the brake position, and the brake element E is also pressed under the action of the spring 11 back onto the counter-brake surface and brake disc S, respectively.

A filling body 14' may be provided in the pressure chamber 14 to keep the volume of the pressure chamber 14 small. This is expedient, since output brakes A with a variable yam clamping force during each yam insertion cycle process exist of a type whose control drive is accommodated in the mounting 7, and since the same mounting is also desired for use in the only manually adjustable output brake A (modular construction), which is shown in FIG. 1. In the last-mentioned output brake A the pressure chamber 14 might be inexpediently large. This drawback is then eliminated by the filling body 14'. Moreover, it is possible to connect the pressure chamber 14 to a separate source of vacuum in each case.

Alternatively, the boundary wall W could also be moved axially by applying excess pressure for adjusting the brake element E in the threading position by arranging the pressure chamber 14 at the side of the movable boundary wall W which is at the left in FIGS. 1 and 2. The compressed-air supply 17 could then be used for acting on said pressure chamber, or also an independent compressed-air supply.

Figure 3:
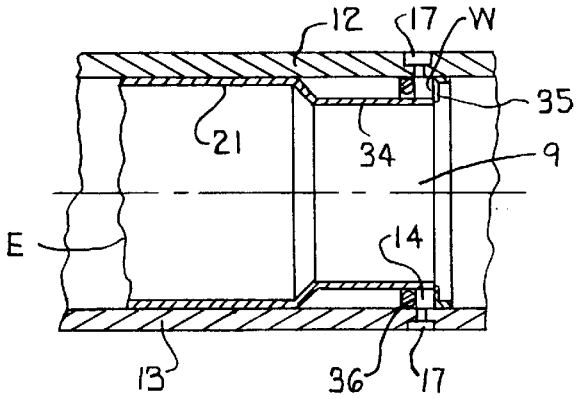
FIG. 3 shows a detail variant in a schematic longitudinal section.

FIG. 3 shows a detail variant of FIG. 1. The tubular attachment 21 of the brake element E is longitudinally movable in a tubular member 12 (corresponding, for instance, to the extension 8') and is guided with a play 13. The tubular attachment 21 has formed therein a restricted portion 34 at the end of which a circular annular piston 35 is located for defining the movable wall in the pressure chamber 14. The inside of the tubular member 12 has provided thereon a surrounding bead 36 which defines the pressure chamber 14 to the left in the manner of a labyrinth seal so that compressed air supplied by the compressed-air supply 17 acts on the circular ring piston 35 with excess pressure and moves the brake element E to the right into the threading position. Optionally, the radial play 13 of the tubular attachment 21 in the tubular part 12 at the left side from the bead 36 is more generously designed than the radial play of the circular ring piston 35 to be able to exploit the pressure in the pressure chamber 14 with the operative direction to the right for adjusting the brake element E. The tubular part 12 is expediently divided in the plane of the center axis for reasons of assembly. In all embodiments the mounting 7 could have provided therein a circular ring piston which is movably guided in the pressure chamber arranged accordingly and which is moved to the right either by a vacuum or an excess pressure and during its travel comes across a carrier of the brake element to adjust the brake element, whereas in the opposite direction it is possibly acted upon by a restoring spring to return after a threading operation back into an inoperative position in which the intrinsic mobility of the brake element is not influenced. This circular ring piston could also be connected directly to the brake element and follow the movements thereof during braking.

Figure 4:
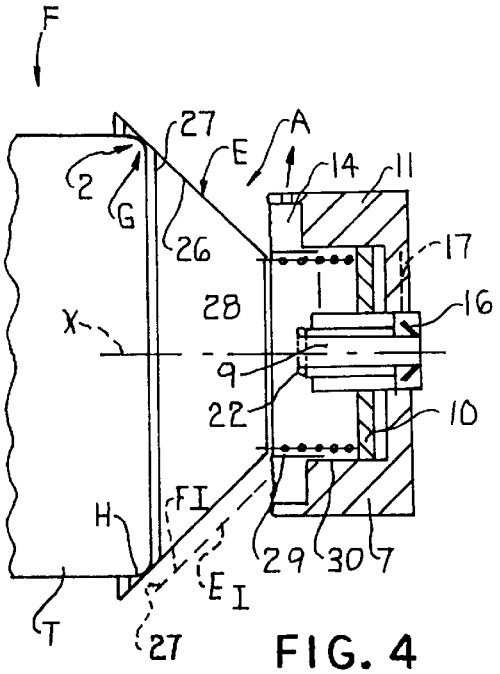
FIG. 4 is a schematic longitudinal section of another variant of the embodiment.

In the yam feeding device according to FIG. 4, the brake element E of the output brake A directly cooperates with the withdrawal edge portion 2 of the storage drum T. A yam brake B as shown in FIG. 1 is not necessary. The brake surface H is defined by a conical brake band 27 which is provided on the inside of a frustoconcial jacket 26 at the larger opening thereof. The frustoconical jacket 26 forms the brake element E together with the brake band 27. The withdrawal edge region 2 of the storage drum T defines the counter-brake surface G. The smaller opening of the frustoconical jacket 26 is, for instance, equipped with an annular reinforcement 28 to which a cylindrical sleeve 29 and the movable boundary wall W, here: a circular ring membrane 15, are secured. The circular ring membrane 15 is externally fixed onto the mounting 7 and defines the pressure chamber 14. The cylindrical sleeve 29 dips into a bore 30 of the mounting 7 with a small play, for instance, in order to seal the pressure chamber 14 relative to the free interior of the mounting 7 in the manner of a labyrinth seal.

The spring 11 is supported with one end on the brake element E and with the other end on the spring abutment 10 which is screwably mounted on the yam guiding channel 9. The pressure chamber 14 can be subjected to a vacuum. The threading nozzle 16 in the yam feeding channel 9 in the mounting 7 is connected to the compressed-air supply 17. When the pressure chamber 14 is subjected to a vacuum, the brake element E is moved into the threading position El (shown in broken line), in which the brake surface H is entirely lifted from the counter-brake surface G and the yam passes easily therethrough to be gripped by the suction flow in front of the yam eyelet 22 and to be sucked into the yam guiding channel 9.

Figure 5:
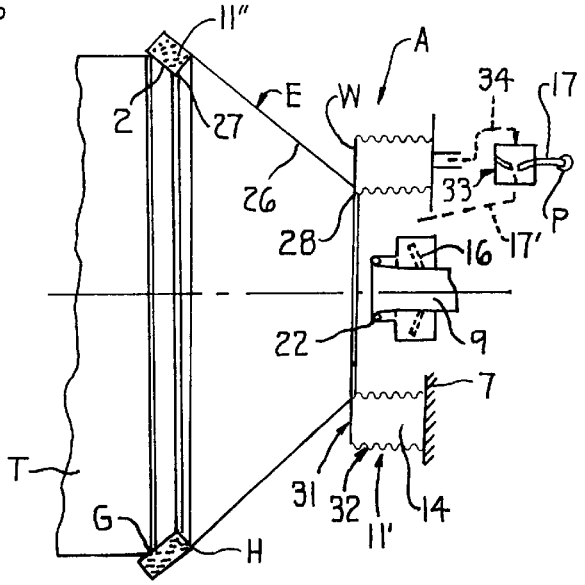
FIG. 5 is a longitudinal section of a further embodiment.

In the embodiment according to FIG. 5, the brake element E, For instance, is supported by means of a circular annular spring bellows 32 in the mounting 7. The conical brake band 27 is held by means of an annular, pressure-elastic plastic body 11" (foamed plastic ring) in the frustoconical jacket 26. The spring bellows 32 acts as a spring 11' which abuts the brake element E with the brake surface H in axial direction on the counter-brake surface G. The movable boundary wall W is an end 31 of the spring bellows 32 which consists of metal sheet or plastics and defines, with its interior, the pressure chamber 14 which is connectable to a vacuum source, for instance, via a line 34. In FIG. 4, the line 34 is connected to a suction blow nozzle 33 which is supplied by the compressed-air supply 17 and which feeds the compressed-air supply 17' for the threading nozzle 16 in the yam guiding channel 9. The suction blow nozzle 33 produces a suction pressure which is transmitted via the line, 34 into the pressure chamber 14 in such a manner that the movable wall W is moved to the right in FIG. 4 and carries along the brake element E into the threading position. The spring bellows 32 is expediently adjustably supported in the mounting 7 for adjusting the axial contact pressure of the brake element E.

The brake element E could also be supported in the mounting 7 in FIG. 5 in the same manner as in FIG. 4, and vice versa. Furthermore, instead of the spring 11 or the spring bellows 32, a spring pack, a resilient membrane or a resilient lamella basket could be used to press the brake element E axially against the withdrawal edge region 2.

I claim:

1. In a yarn feeding device comprising a storage drum for a yarn and an output brake which is arranged at a withdrawal end of the storage drum, said output brake comprising a storage drum counter-brake surface which is coaxial to the storage drum axis and is continuous in a circumferential direction and a brake element held on said counter-brake surface under a spring action wherein said spring action acts axially and counter to a yarn withdrawal direction, said brake element having a brake surface which is also continuous in the circumferential direction and coaxial to said storage drum axis, said yarn feeding device further comprising a mounting for said brake element, which said mounting is separated from said storage drum, and a pneumatically operable brake opening device which comprises a pressure chamber having a pneumatically loadable, axially movable boundary wall, comprising the improvement wherein said boundary wall is connected in motion-transmitting fashion to said brake element such that movement of said boundary wall effects movement of said brake element at least in a direction of movement against said spring action, said output brake including a pressure supply arrangement which pressurizes said pressure chamber with an elevated pressure or a vacuum such that said boundary wall moves in said direction of movement, said brake element being axially movable into a threading position when said boundary wall is pressurized by the elevated pressure or the vacuum such that said brake surface is lifted from said counter-brake surface to permit threading of the yarn therebetween.

2. A yarn feeding device according to claim 1, wherein said pressure supply arrangement of said output brake comprises a threading nozzle which is connected to a supply of pressure and is operative into a yarn withdrawal channel such that said threading nozzle produces a suction flow in the area of an inlet of said output brake and a blow flow is produced downstream thereof, said pressure chamber being pressurized either with a suction pressure of said suction flow or with a blow pressure of said blow flow which acts thereon.

3. A yarn feeding device according to claim 1, wherein said boundary wall is an elastic, at least substantially air-impermeable circular ring membrane in planar form or with concentric undulations, said circular ring member encompassing said brake element externally thereof and fixing said brake element to said mounting.

4. A yarn feeding device according to claim 1, wherein said boundary wall is a circular ring piston which is slidably guided in said pressure chamber and which encompasses said brake element externally thereof.

5. A yarn feeding device according to claim 4, wherein said circular ring piston is provided on said brake element or on a tubular attachment connected thereto.

6. A yarn feeding device according to claim 1, wherein said boundary wall is defined by an end of a circular, hollow spring bellows which simultaneously forms the spring that produces said spring action for said brake element, said bellows being supported on said mounting.

7. A yarn feeding device according to claim 1, wherein said brake element is a frustoconical jacket having a larger opening which is defined by a larger end portion thereof and a smaller opening, said jacket including a band-shaped brake lining held on an inside of said larger end portion by a pressure-elastic intermediate ring to define said brake surface, said jacket having a frustoconical axis located in said storage drum axis and being disposed with said larger opening over a free end of said storage drum, said jacket being biased by said spring action such that said brake lining abuts against a yarn withdrawal edge region of said storage drum which said edge region defines said counter-brake surface, said movable boundary wall being connected to said jacket in an area of said smaller opening.

8. A yarn feeding device according to claim 1, wherein said brake element is a circular annular brake disk with a bent outer edge, a planar ring flange defining said brake surface, and a tubular attachment extending from an inner diameter of said ring flange in an axial direction, said movable boundary wall being secured to said outer edge or to said tubular attachment, and said ring flange abutting under said spring action on said counter-brake surface, said counter-brake surface having a substantially smaller diameter than an outer diameter of said storage drum.

9. A yarn feeding device according to claim 8, wherein said ring flange and said circular counter-brake surface are planar and arranged in a direction substantially perpendicular to the axial direction of said storage drum.

10. A yarn feeding device according to claim 8, wherein said tubular attachment is guided in longitudinally displaceable fashion in a guide channel fixed to said mounting, an inner wall of said guide channel being formed with longitudinally extending ribs and grooves which define flow paths leading to said pressure chamber.

11. A yarn feeding device according to claim 1, wherein said brake surface is spaced from said counter-brake surface when said brake element is in said threading position to define an annular gap therebetween.

12. A method of opening an output brake of a yarn feeding device, said output brake having two brake surfaces which are coaxial to the axis of a storage drum and being arranged in a direction transverse to the storage drum axis, said brake surfaces abutting on each other and being continuous in a circumferential direction, one of said brake surfaces being provided on said storage drum and the other of said brake surfaces being provided on a mounting which said mounting is separate from said storage drum, comprising the steps of:

biasing said brake surfaces toward each other by a spring action;

providing a brake opening device;

lifting one of said brake surfaces from the other brake surface by said brake opening device by moving said one brake surface against said spring action to a threading position;

providing a threading nozzle for threading yarn;

supplying an elevated pressure to said threading nozzle to simultaneously produce a suction flow and/or blow flow in a yarn guiding channel; and transmitting a suction pressure of said suction flow to said brake opening device such that said one brake surface is moved to said threading position.

13. The method according to claim 12, further comprising the steps of:

providing a pressure chamber in said brake opening device which includes a movable boundary wall, said boundary wall being connected to said one brake surface; and pressurizing said pressure chamber by said suction flow to move said boundary wall and lift said one brake surface away from said storage drum.

14. The method according to claim 13, further comprising the step of:

providing a passage between said pressure chamber and said yarn guiding channel, said suction flow being produced proximate said passage to produce a vacuum within said pressure chamber.

* * * * *